US006699095B1

(12) United States Patent
Epstein

(10) Patent No.: US 6,699,095 B1
(45) Date of Patent: Mar. 2, 2004

(54) TOY BALLOON WITH INTEGRAL INFLATABLE HANDLE

(76) Inventor: Marc I. Epstein, 1172 Park Ave., Suite #4D, New York, NY (US) 10128

( * ) Notice: Subject to any disclaimer, the term of this patent is extended or adjusted under 35 U.S.C. 154(b) by 0 days.

(21) Appl. No.: 10/138,233

(22) Filed: May 1, 2002

(51) Int. Cl.[7] ..... A63H 3/06
(52) U.S. Cl. ..... 446/222
(58) Field of Search ..... 446/220, 221, 446/222, 224

(56) References Cited

U.S. PATENT DOCUMENTS

| | | | | |
|---|---|---|---|---|
| 4,486,975 A | | 12/1984 | Harreld et al. | 446/220 |
| 4,715,841 A | | 12/1987 | Nelson et al. | 446/222 |
| 4,895,545 A | | 1/1990 | Nelson | 446/220 |
| 4,917,646 A | * | 4/1990 | Kieves | 446/224 |
| 5,188,558 A | * | 2/1993 | Barton et al. | 446/224 |
| 5,295,892 A | * | 3/1994 | Felton | 446/224 |
| 5,306,194 A | | 4/1994 | Epstein | 446/224 |
| 5,334,072 A | | 8/1994 | Epstein | 446/224 |
| 5,451,179 A | * | 9/1995 | LaRoi et al. | 446/224 |
| 5,860,441 A | * | 1/1999 | Garcia | 137/15.18 |
| 6,176,758 B1 | * | 1/2001 | Wu | 446/224 |

* cited by examiner

*Primary Examiner*—Derris H. Banks
*Assistant Examiner*—Bena B. Miller
(74) *Attorney, Agent, or Firm*—Cooper & Dunham LLP; William E. Pelton; Donald S. Dowden

(57) ABSTRACT

A balloon has an inflatable main body with a flexible extension. The extension is connected to the main body in such a manner that, when they are inflated, the extension forms a semirigid handle. The balloon therefore requires no separate holder. The balloon can be deflated for storage or shipment and reinflated when desirable or necessary.

8 Claims, 11 Drawing Sheets

TOY BALLOON WITH INTEGRAL INFLATABLE HANDLE

BACKGROUND OF THE INVENTION

1. Field of the Invention

This invention relates to balloons and more particularly to a novel balloon that is inexpensive and can safely be used by children.

2. Description of the Prior Art

Balloons are popular as toy or novelty items. At present, such balloons are sold in two widely available forms, namely those made of a stretchable material, usually latex, and those made of unstretchable material, usually nylon (a polyamide), Mylar (a polymer; Mylar is a registered trademark of E. I. DuPont de Nemours and Company), or "mylar," the name commonly albeit erroneously applied to a replacement for Mylar made of an outer layer of nylon laminated to an inner layer of polyethylene. Latex and other balloons made of a stretchable material may be sold either collapsed or inflated. Balloons made of unstretchable material are nearly always sold in inflated form.

Whether sold inflated or uninflated, balloons made of unstretchable material are filled to the desired pressure with a desired fluid such as air or helium and then sealed by tying the neck off with a string or the like or crimping the neck with a clip or a cup-and-stick support assembly, or by means of a heat seal or a self-sealing valve. Regardless of the sealing technique used, such balloons when inflated may thereafter be supported or held by means of a holder, which is typically a funnel-shaped plastic cup formed at one end of a plastic stick and having means such as apertures or slots for use in securing the balloon to the cup and stick.

Examples of these prior art holders are disclosed in U.S. Pat. Nos. 4,715,841 and 4,895,545. Such holders are normally used with balloons that have a diameter less than about 18 inches when inflated and that are sealed with heat. U.S. Pat. Nos 5,306,194 and 5,334,072 describe an alternative structure including a common drinking straw that functions as an inflation tube when it is inserted into the tail of a balloon containing a self-seal valve. When the balloon is inflated, the balloon's air pressure seals the valve, which grips the straw to form a rigid holder. U.S. Pat. No. 4,486,975 describes a different construction for holding a non-balloon inflatable novelty item comprising an uninflated cavity in which a hand is inserted.

The most popular type of balloon holder consists of a funnel-shaped cup for receiving and crimping the neck of a balloon to seal and/or secure it. The cup is sometimes integrally attached to a stick by which the balloon is held. The cup is typically provided with a plurality of holes or slots for engaging the neck of the balloon to crimp the neck both to seal it and to secure the balloon to the cup. By way of example, the neck of the balloon is threaded through and wound around the slotted cup and secured to the holder near its end. The body of the balloon is thereby intended to nest into and be supported by the funnel-shaped cup of the balloon holder. Still another type of balloon holder known heretofore, referred to as the "clip'n stick," consists of a stick with an integral loop and clip to seal and/or secure the balloon and its inlet portion.

Such prior types of balloon holders are difficult to manipulate, the balloon is not firmly secured and has a tendency to separate from the holder, and refilling of the balloon with a desired fluid such as air or helium is cumbersome. The cup and the tied-off neck of the balloon are, moreover, unsightly. A more serious matter is that a rigid stick or straw can injure a child who falls on it. Finally, no matter how they are manufactured, the cup, stick or straw portion of such a balloon holder adds undesirable cost to the overall manufacturing and commercializing process.

There are other disadvantages to the prior types of balloon holders. For example, the difficulty of attaching the popular cup and stick holders to the balloons has heretofore frequently placed the burden of doing so on manufacturers or distributors in advance of sale to the retailer, thereby necessitating inflation of the balloons and attachment of the cup and stick to the inflated balloon before transporting the product and increasing the cost and the storage space required to handle the product prior to sale. This difficulty has also discouraged or prevented virtually any meaningful sales to consumers of uninflated balloons made of unstretchable material.

Latex balloons also have serious problems. The U.S. 1994 Child Safety Protection Act requires the following warning label on the front of all latex balloon packages and displays: "CHOKING HAZARD—Children under 8 years can choke or suffocate on uninflated or broken balloons. Adult supervision required. Keep inflated balloons from children. Discard broken balloons at once." Latex balloons also threaten the health and even the lives of children and adults who suffer from latex allergy.

FIGS. 8–10 illustrate some representative structures of the prior art.

FIG. 8 shows a balloon-tail assembly for a helium-fill balloon made of unstretchable material and comprising a self-seal valve 40 and an inlet 41, with a channel for fluid flow. The tail assembly is too small and flexible to form a holder capable of properly supporting a relatively large, heavy balloon main body 42. In addition, this short tail 43 has a pinched rounded end 44 to facilitate the secure attachment of a tether for a floating balloon.

FIG. 9 shows a helium-fill balloon made of unstretchable material. An inflation probe or nozzle 45 inserted in the valve within the tail 46 preempts a great deal of space within the tail assembly.

FIG. 10 shows a balloon-tail assembly for an air-filled smaller balloon 47 made of unstretchable material. It has an inflation port 48 and channel to communicate air to a channel 49 that is intentionally minimized to facilitate both heat sealing near the throat 50 and threading the uninflated bottom portion 51 around a prior-art hard plastic cup and/or stick holder.

OBJECTS AND SUMMARY OF THE INVENTION

An object of the invention is to remedy the problems of the prior art outlined above. In particular, an object of the invention is to provide a balloon that is inexpensive and can be easily inflated and safely used by children.

Another object of the invention is to provide a balloon that can be sold as a toy or novelty item and that is unusually inexpensive, even for an item of this type, to manufacture, transport, display and vend.

One object of the present invention is to provide a handle for a balloon, having means for tightly and securely holding a balloon, including one having a diameter of over nine inches, which would generally be too large to be affixed to and properly supported by the prior types of stick-with-cup or straw-with-self-seal valve holders.

Another object of the present invention is to form a balloon holder in such a way as to eliminate the cost of the prior type of balloon-holding stick-with-cup, eliminate the labor required to attach the balloon to such stick-with-cup holder, efficiently and economically form the holder coincident with present-day sealing processes, and provide a more reliable attachment and vertical retention of the balloon relative to the holder.

Yet another object of the present invention is to provide a holder for such a balloon which may be used in conjunction with either a heat-sealed closure for the balloon or a self-sealing valve.

Still another object of the present invention is to provide a holder for such a balloon that enables the balloon to be quickly and easily inflated and sealed, thereby facilitating inflation by retailers or the public so as to reduce costs heretofore incurred for shipping inflated balloons with sticks and/or cups attached and to eliminate concomitant costs for damaged or unsalable "leakers."

A further object of the present invention is to provide a holder that permits the balloon to be manufactured from lighter gauge plastic than has heretofore been necessary to avoid or minimize shipping and handling damage to pre-inflated balloons.

A still further object of the present invention is to provide a safe balloon/holder combination that, by facilitating consumer inflation and assembly, opens new markets for air-filled plastic balloons, such as self-service mass merchandiser multi-packs, greeting cards, manufacturer and retailer premiums, advertising specialties, direct mail inserts and point of purchase signs.

A yet further object of the present invention is to provide a holder especially adapted for nylon or other polymer film that will enable such balloons to fully exploit their advantages vis-à-vis latex balloons of easier inflation and sealing, safer use by children, greater attractiveness, greater suitability for graphics and messages, and greater resistance to bursting or loss of air due to other causes.

The foregoing and other objects of the invention are attained by providing a balloon comprising an inflatable main body with an inflatable extension, wherein the extension is connected to the main body in such a manner that, when they are inflated, the extension forms a balloon handle.

The balloon is preferably made of an unstretchable material such as polyethylene (high density, low density, or a blend of the two), nylon or a nylon-polyethylene laminate, and is intended for sale as a novelty item or toy balloon for use by children.

In accordance with an independent aspect of the present invention there is provided a non-latex toy balloon comprising:

- two overlying coterminous sealable panels of substantially unstretchable flexible film having edge seals joining said panels together to define an inflatable main body with an integral inflatable extension connected by a throat and enclosing an interior space;
- an inflation port formed in one of the main body, the throat and the extension for communicating a fluid to the interior space; and
- a seal for sealing the inflation port.

BRIEF DESCRIPTION OF THE DRAWINGS

A better understanding of the objects, features and advantages of the invention can be guided from the following detailed description of preferred embodiments of the invention, in conjunction with the appended figures of the drawing, wherein.

BRIEF DESCRIPTION OF THE PREFERRED EMBODIMENTS

Figure 1:
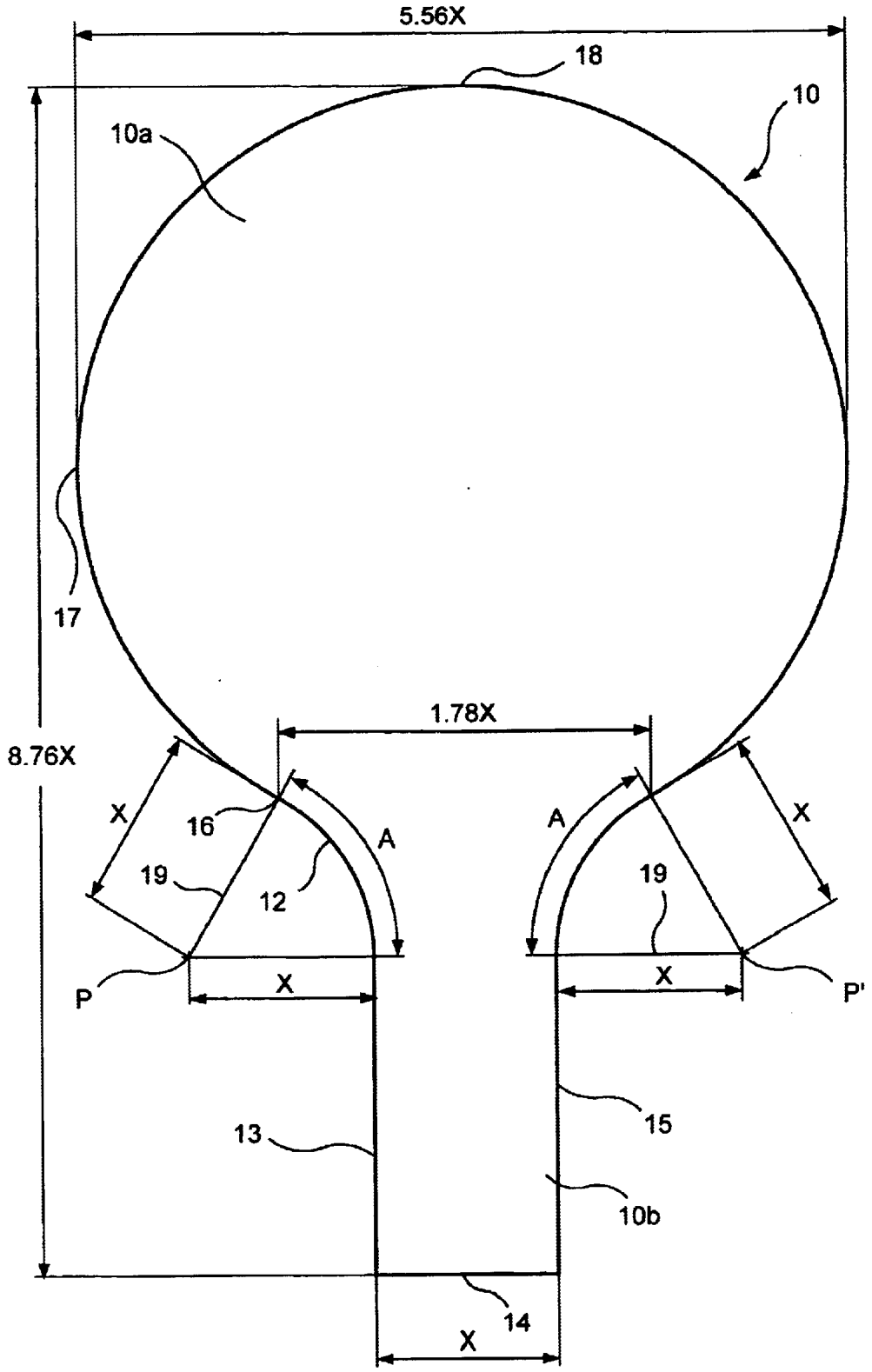
FIG. 1 is a view in front elevation of a flat, uninflated (collapsed) balloon constructed in accordance with the invention and shows exemplary proportional dimensions and radii.

FIG. 1 shows a balloon 10 comprising an inflatable main body 10*a* and an inflatable handle-forming extension 10*b*. The balloon 10 is shown uninflated in FIG. 1. A throat 12 connects the main body 10*a* and the extension 10*b*. An inflation port 14 is provided in the extension, though it could be provided elsewhere on the balloon, such as the main body 10*a* or throat 12, as shown respectively in FIGS. 1A (item 14*a*) and 1B (item 14*b*). The main body 10*a* and extension 10*b* are in fluid communication with each other. Although there is no single set of required dimensional ratios, or radii, one preferred set is noted for width 15 of the extension 10*b*, the throat width 16, the main-body diameter 17, the overall height 18, and the throat radii 19. That is, if the extension width 15 is x (in inches or other suitable units), the throat width is 1.78x, the main-body diameter is 5.56x, and the overall height is 8.67x. The throat 12 is curved in three dimensions. In FIG. 1, if points P and P' are a distance x from the throat, the arc A connecting the main body 10*a* and the extension 10*b* is about one radian. (The points P and P' are the intersections with the plane of FIG. 1 of a circle equidistant from the throat 12 and lying in a plane perpendicular to the plane of FIG. 1.) These proportional dimensions are among a number of sets of dimensions that are suitable for the rigid extension-main body connection to securely support the main body 10*a* without bending of the semirigid (when inflated) extension or handle 10*b*. These proportional dimensions also strengthen the extension's resistance to being torn off into a critical part that would fail the Consumer Product Safety Commission's "small parts" test.

Figure 1A:
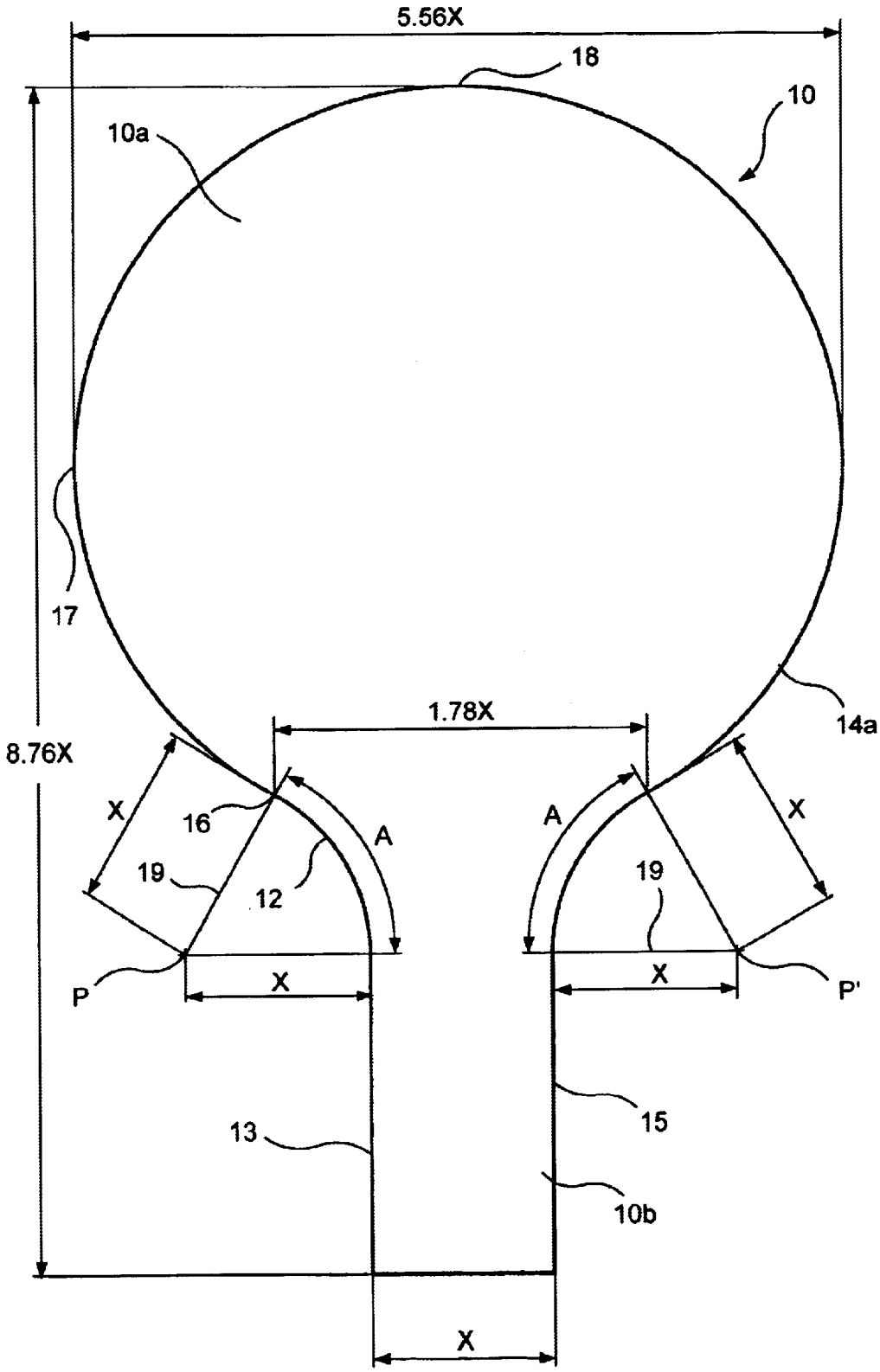
FIG. 1A is a view of the structure illustrated in FIG. 1 with the inflation port in the main body of the balloon.
Figure 1B:
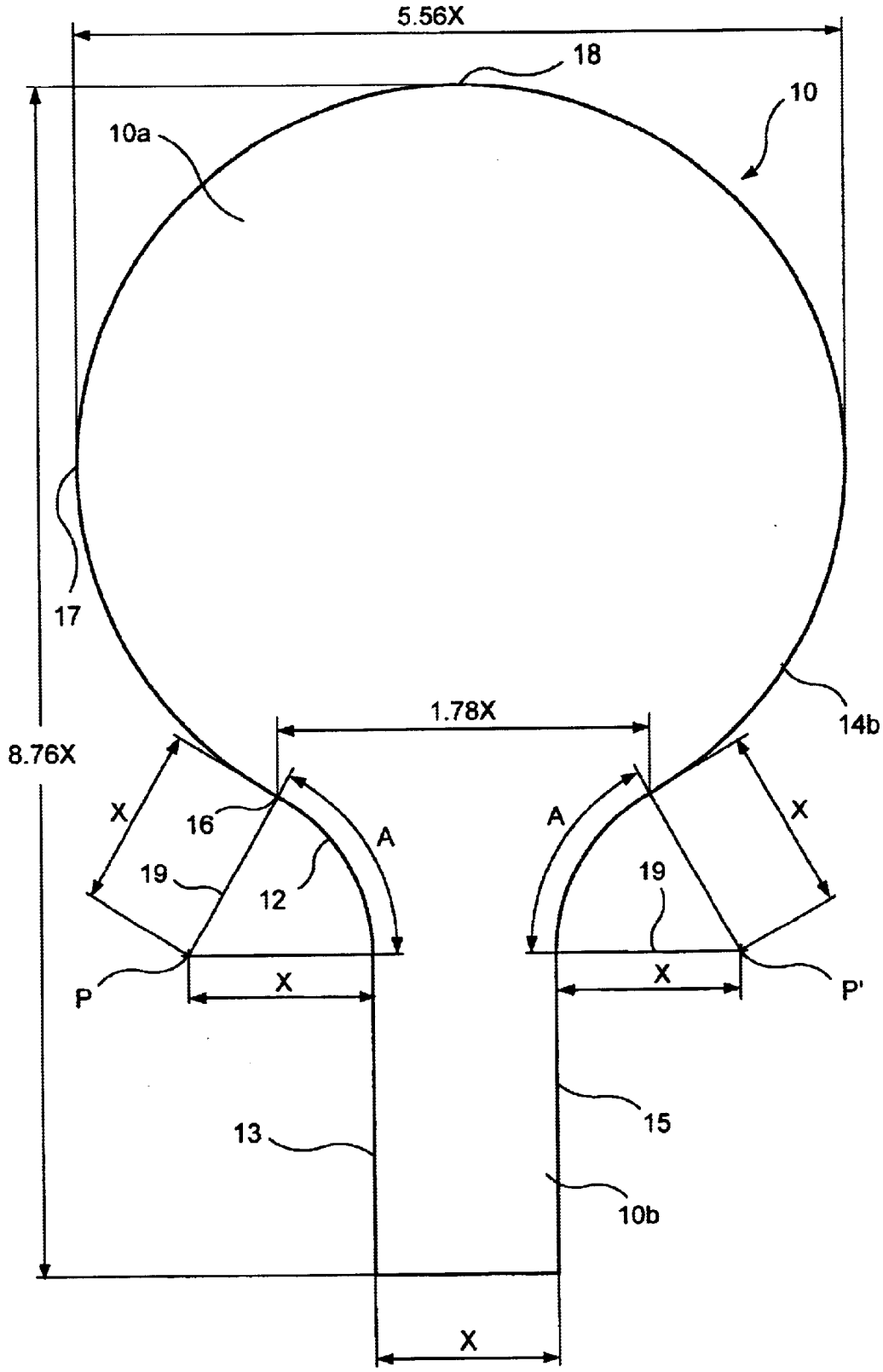
FIG. 1B is a view of the structure illustrated in FIG. 1 with the inflation port in the throat of the balloon.

FIG. 1A shows the inflation port 14*a* in the main body 10*a* instead of in the extension or handle 10*b*. FIG. 1B shows the inflation port 14*b* in the throat 12.

Figure 2:
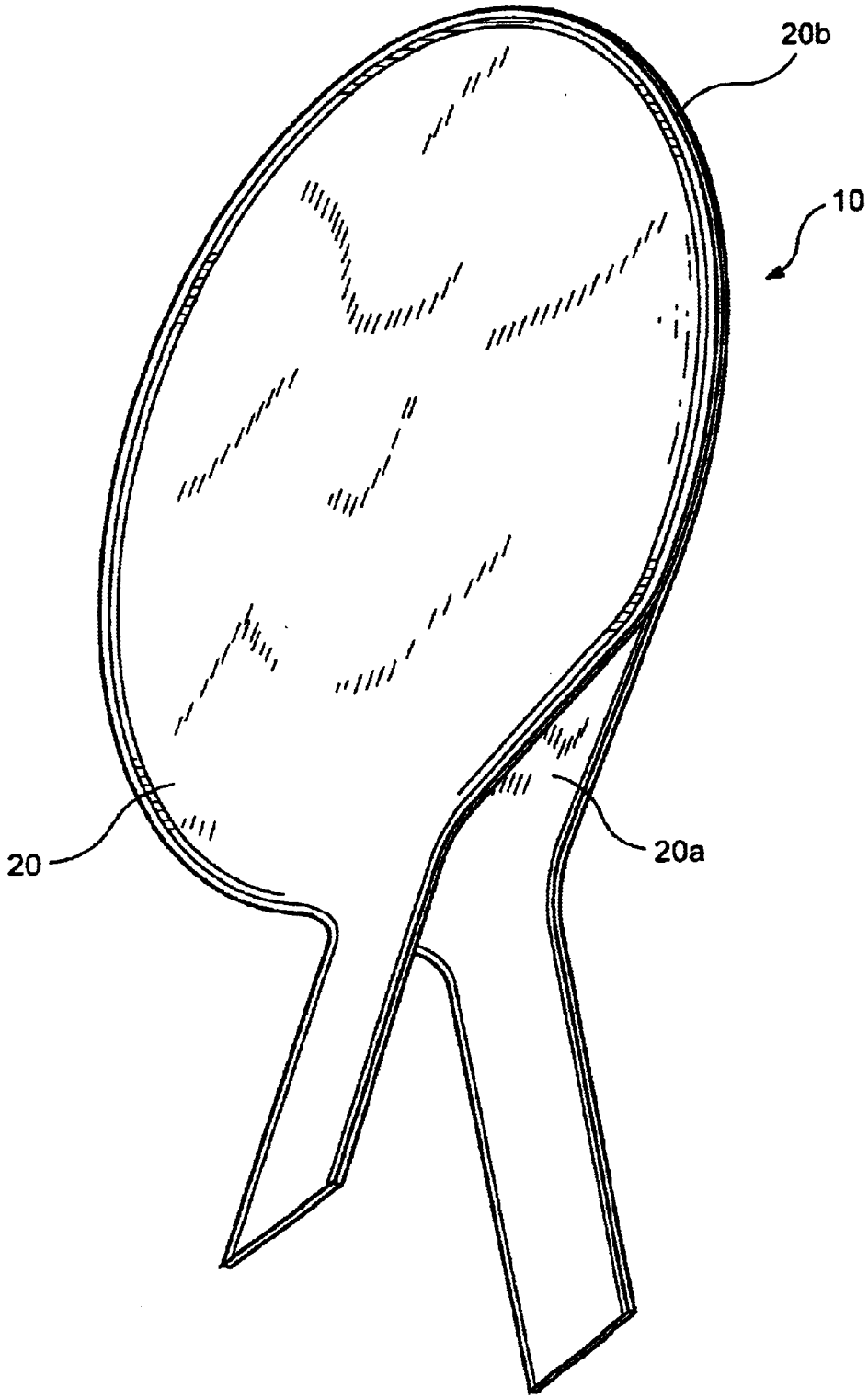
FIG. 2 is a perspective view of the balloon of FIG. 1, illustrating two sheets of which the balloon is made in partly separated relation.

FIG. 2 illustrates the bonding of two sheets of film 20 and 20*a* along a seam 20*b* that runs around the perimeter of the balloon 10.

Figure 3:
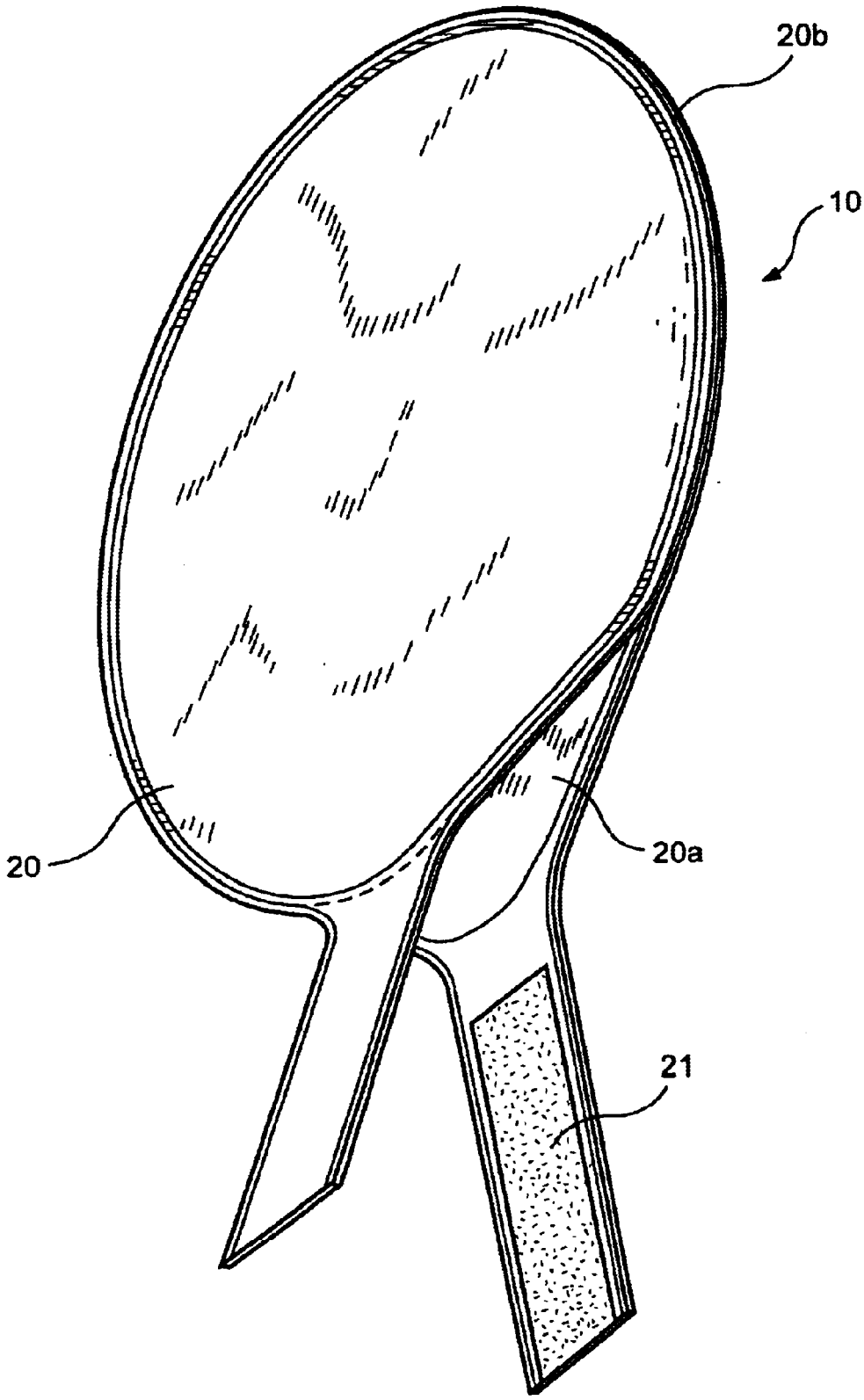
FIG. 3 is a perspective view of the structure of FIG. 2 showing the addition of a flat self-seal valve inserted into and affixed to an extension from the balloon.

FIG. 3 shows a self-seal valve 21 (well known in the art) as one several sealing methods for retaining the fluid when the balloon 10 is inflated.

Figure 4:
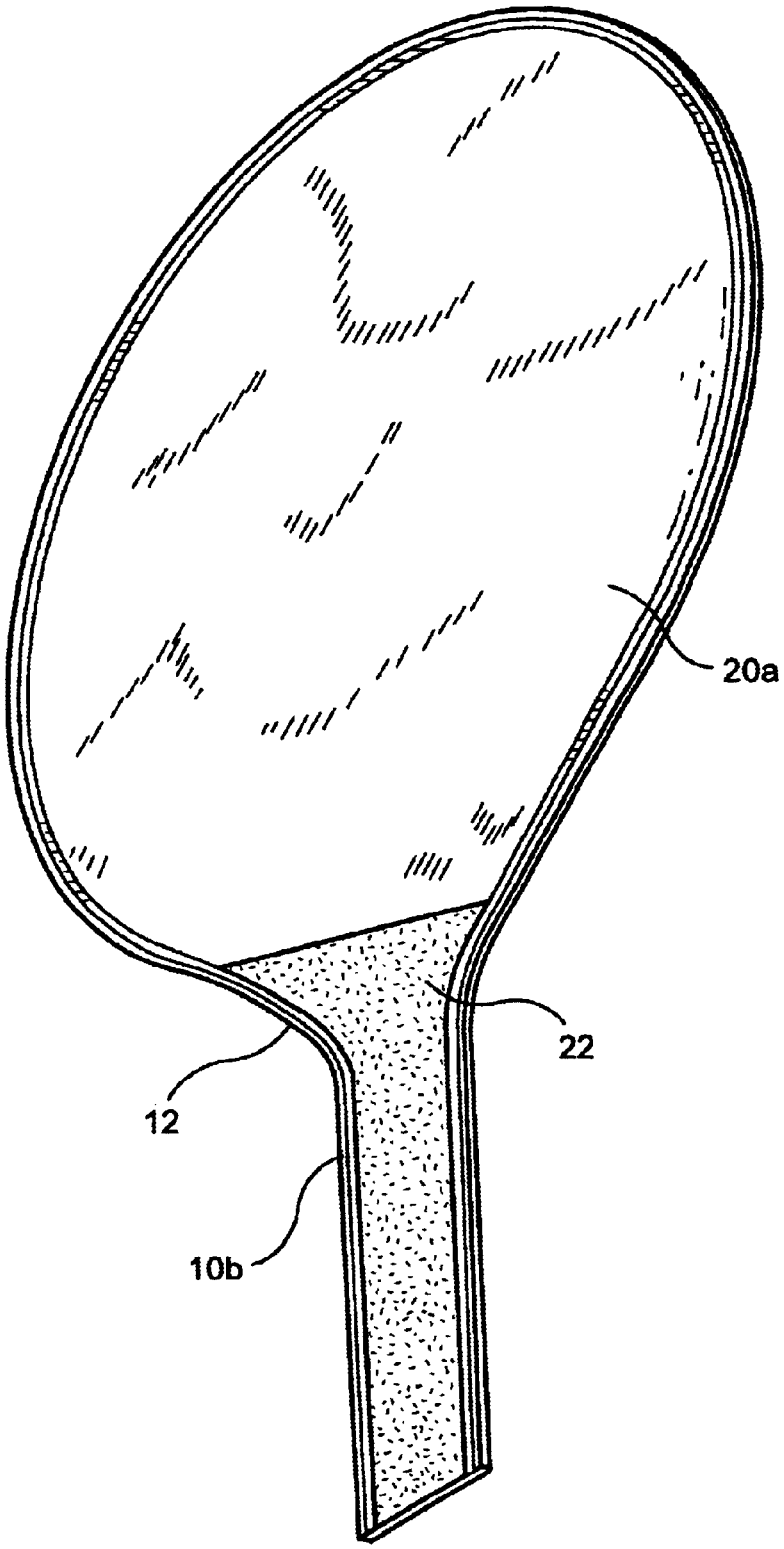
FIG. 4 is a fragmentary perspective view of structure similar to that shown in FIG. 3 but showing an embodiment of the invention wherein a polymer film is firmly attached to the balloon throat and extension to enhance rigidity and resistance to tension-caused tearing into small pieces.

FIG. 4 is a fragmentary perspective view of structure similar to that shown in FIG. 3 but showing an embodiment of the invention wherein a layer of polymer film 22 firmly attached to handle 10*b* upwards through the throat 12 by means of heat sealing the coterminous perimeter edges. FIG. 4 shows only the lower sheet 20*a* in order better to illustrate the polymer film 22, the upper sheet 20 (FIG. 3) is omitted in FIG. 2. FIG. 4 illustrates one of several means of enhancing the rigidity and strength of the structure.

Figure 5:
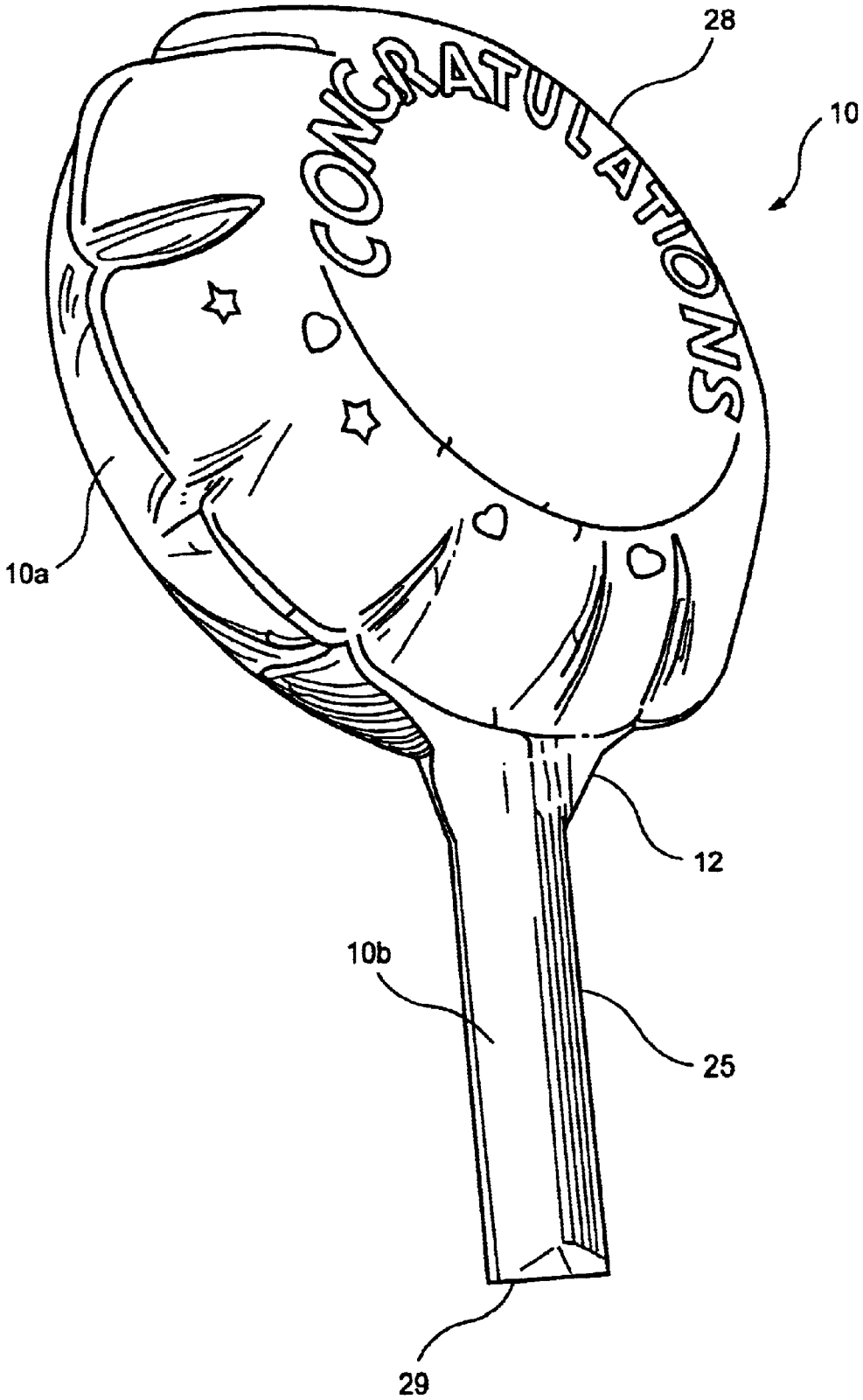
FIG. 5 is a perspective view of a balloon constructed in accordance with the invention in a fully inflated and sealed condition.

FIG. 5 shows the fully inflated balloon 10, including the main body 10*a*, the integral extension or handle 10*b*, the throat 12, and a heat seal 29. FIG. 5 also shows the addition of an optional legend 28.

Figure 6:
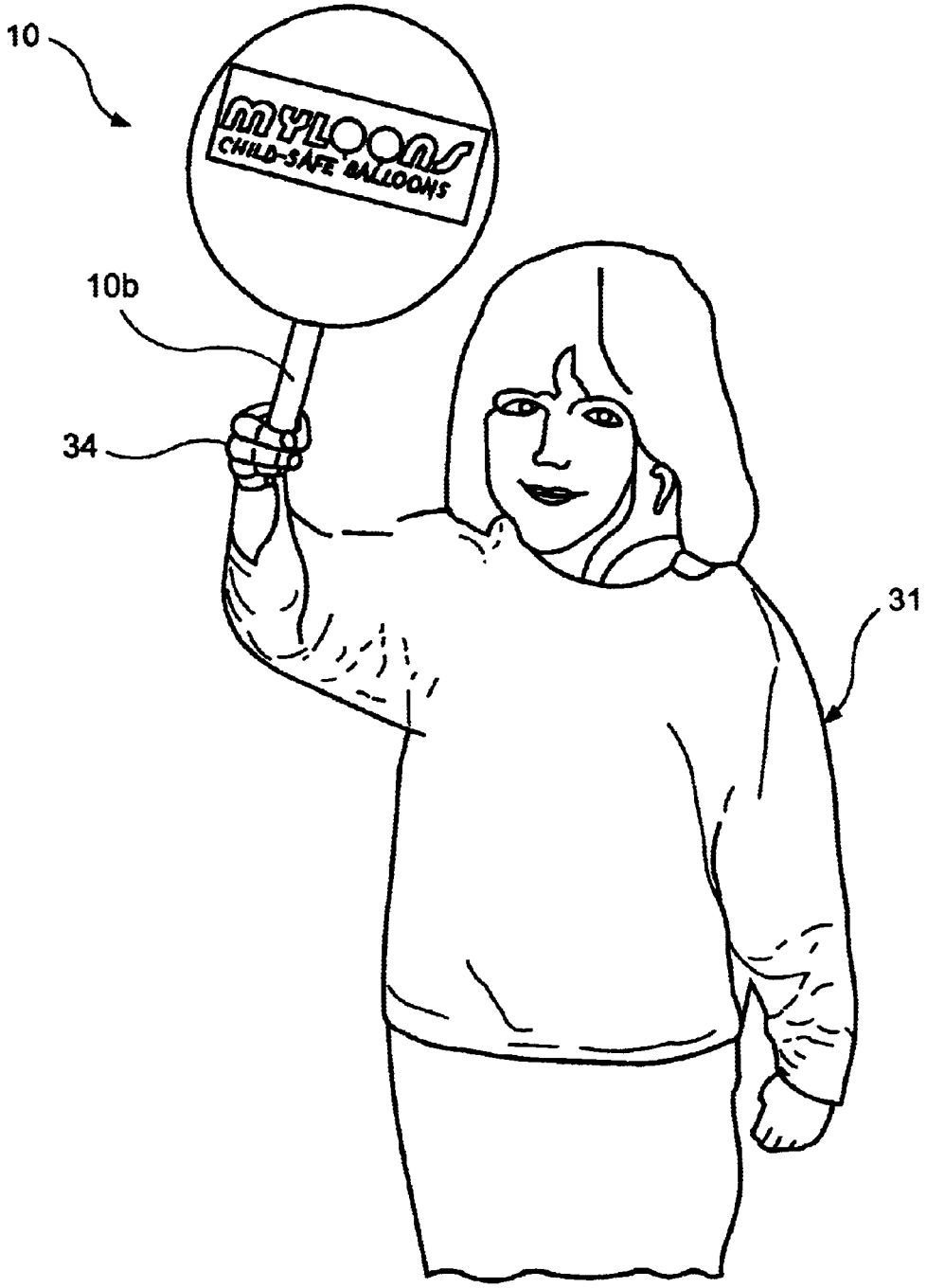
FIG. 6 is a diagrammatic view of a young girl holding aloft a balloon constructed in accordance with the invention and in a fully inflated and sealed condition.

FIG. 6 illustrates a young girl 31 holding the inflated balloon 10 aloft by gripping the extension or handle 10*b* with her hand 34.

Figure 7:
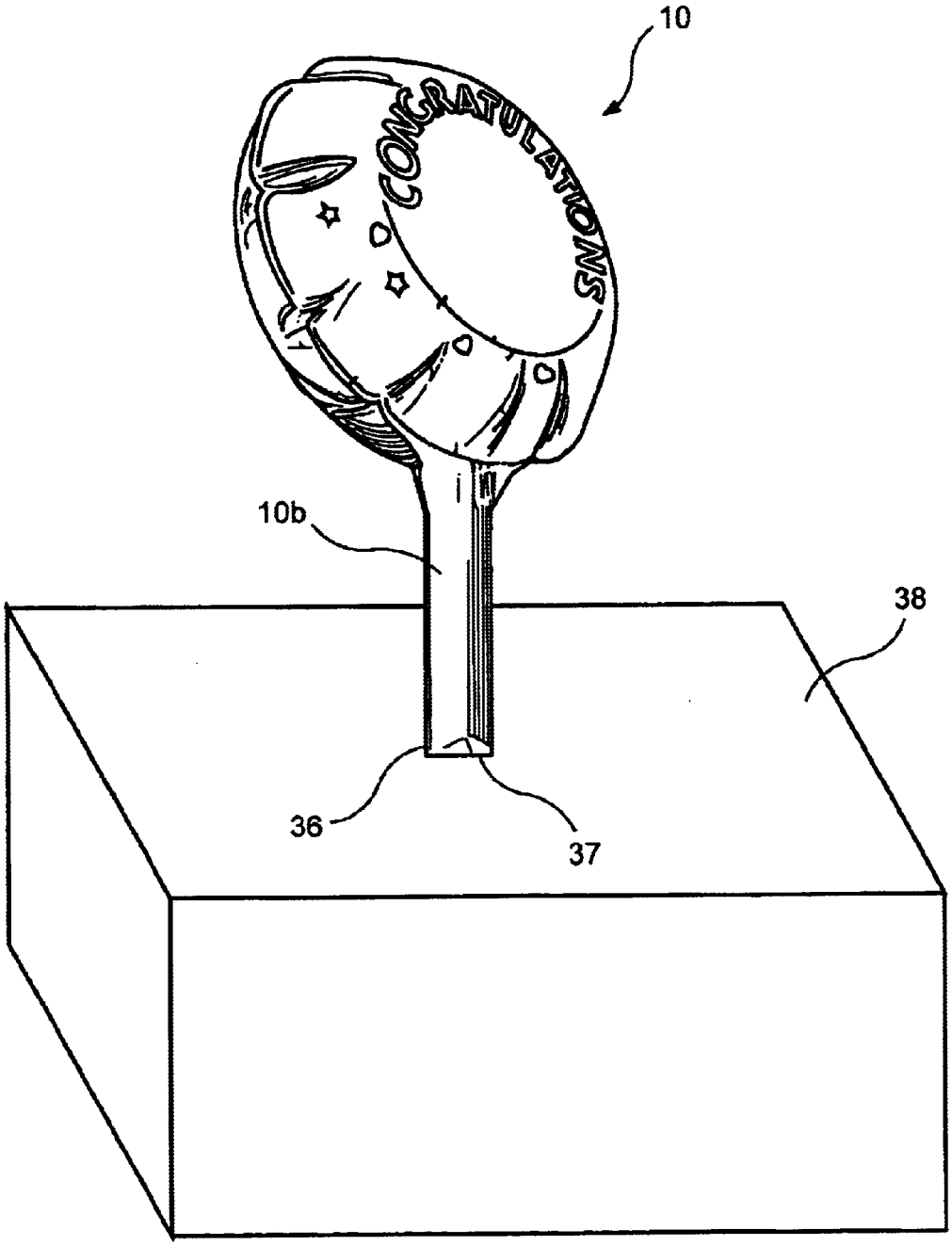
FIG. 7 is a perspective view of the inflated balloon provided with two-sided tape to serve as a stand for the balloon.
Figure 8:
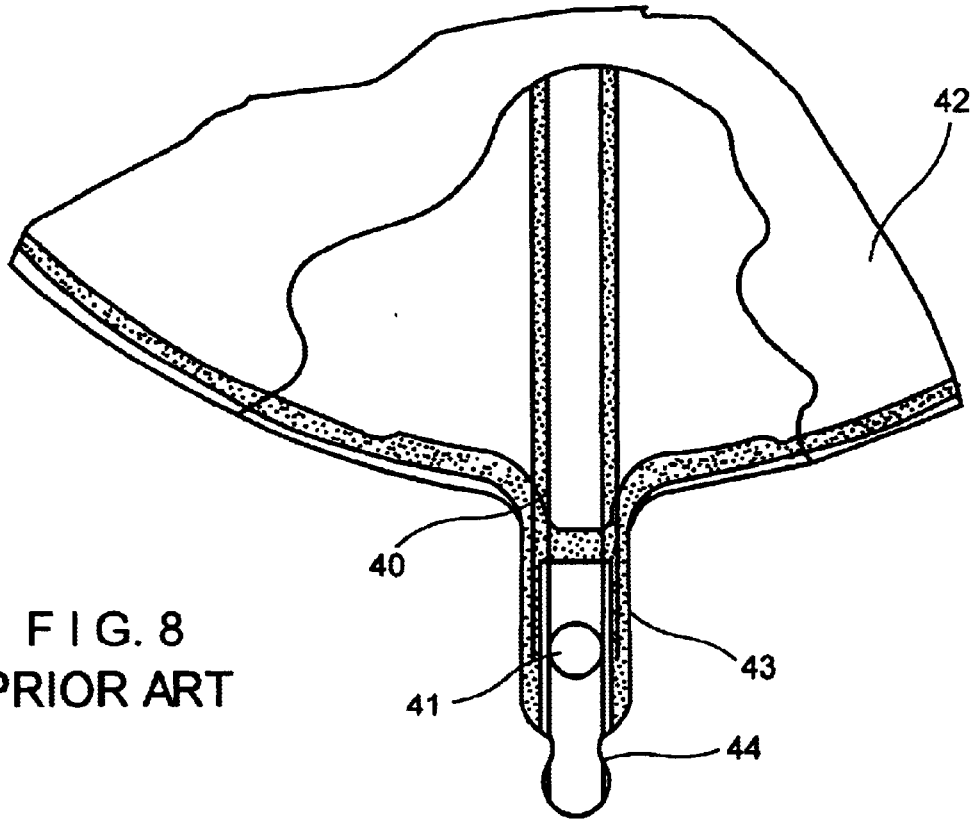
FIG. 8 PRIOR ART
FIG. 8 is a fragmentary view in front elevation, partly broken away, of an uninflated prior art balloon and valve assembly for a typical helium-fill balloon made of unstretchable material.
Figure 9:
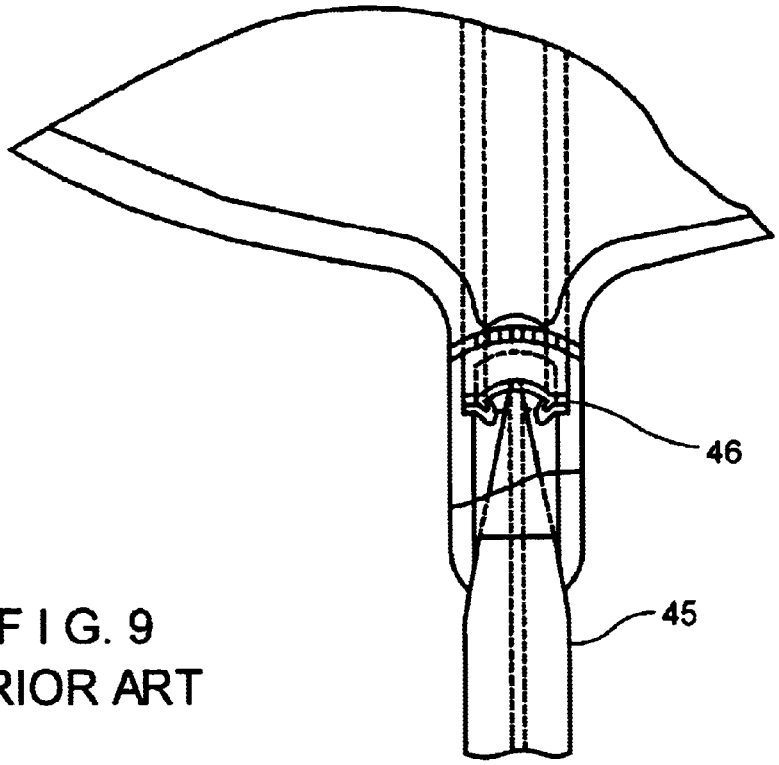
FIG. 9 PRIOR ART
FIG. 9 is a fragmentary perspective view, partly broken away, similar to FIG. 8 but showing an inflation probe or nozzle inserted in a self-seal valve contained in the tail of a prior-art balloon.
Figure 10:
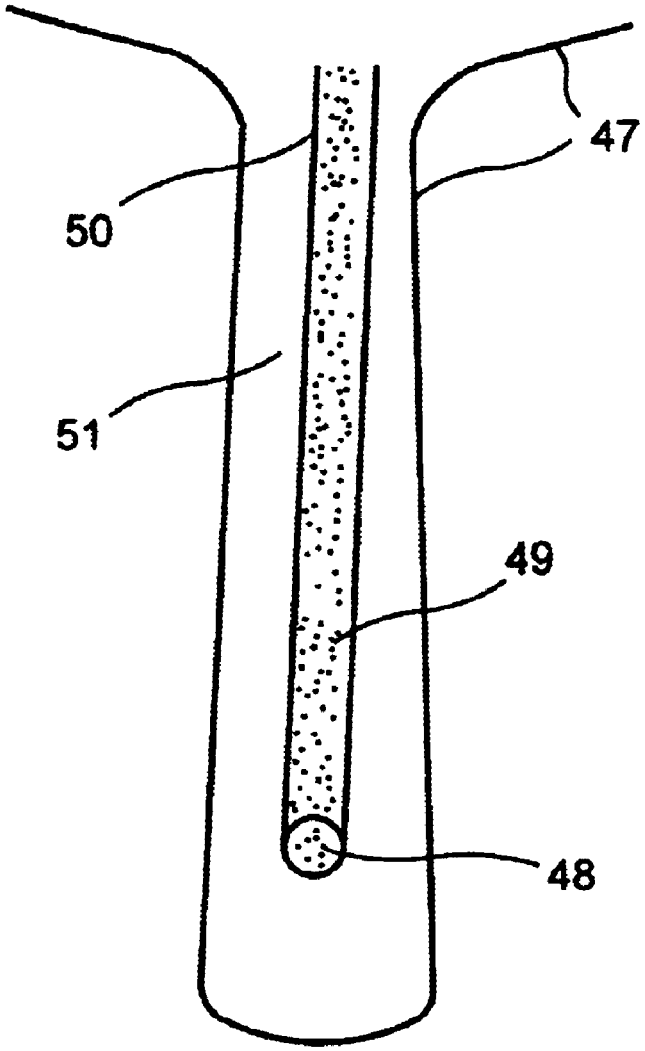
F I G. 10 PRIOR ART
FIG. 10 is a fragmentary view in front elevation, partly broken away, of an uninflated prior-art balloon and tail assembly for a conventional air-filled "stick balloon" made of unstretchable material.

FIG. 7 shows a "greeting balloon" version of the invention. A short strip of two-sided tape 36 (e.g. Scotch® brand) is affixed to bottom 37 of the handle 10*b*, which is in turn affixed to a flat smooth surface, by way of example the top of a box or table 38. By merely affixing the small strip of two-sided tape 36 to the bottom end 37 of the inflated handle 10*b* of the inflated balloon 10, the balloon's handle becomes a convenient, economical stand for a greeting balloon. It will be evident to those skilled in the art that other forms of such balloon stands may be used without departing from the scope of the present invention.

The inflatable non-latex novelty balloon made of nylon and/or polymer film in accordance with the invention, when inflated to a desired air pressure and sealed, causes the extension to define a reinforced handle that supports the main body of the balloon. Preferably, balloons according to the invention are embodied as inflatable novelty items made of a flexible, substantially unstretchable nylon and/or polymer film and are used as decorations, advertising specialties, promotional premiums and party favors.

The present invention facilitates much easier mouth inflation by end users (including children) than latex, thus providing a convenient, safe alternative to the life-threatening risks of latex balloons.

The disadvantages of the prior type of balloon holders are eliminated by the present invention, which obviates the need for a separate holder attached to the neck of the balloon before or after inflation.

The present invention, especially with a self-sealing valve, may be easily deflated and reinflated, when desirable or necessary. The present invention uses an inflated appendage which bends under slight pressure before it can puncture clothing and/or flesh. Prior types of so-called "tails" on helium and air-filled balloons made of unstretchable material are neither designed for, nor function as, an inflated handle. In fact, inflatability would defeat their primary functions. The short tail for helium balloons having a diameter of 18 inches or more contains a flat self-seal valve and a portal for insertion of a nozzle. The short, flat (and frequently shaped) tail with a narrow channel facilitates attaching a tether to the balloon. Longer tails for air-filled stick balloons made of unstretchable material are flat with a narrow air channel to facilitate heat sealing and attachment to the cup holder.

The figures and the description thereof set forth herein are for the purpose of illustrating the present invention and are not to be construed as limiting the present invention to the structures shown in the drawing figures. Persons skilled in the art will recognize that various changes may be made in the construction without departing from the scope of the invention. All such changes are within the spirit and scope of the present invention as defined by the following claims.

What is claimed is:

1. A balloon comprising:

an inflatable main body;

an inflatable extension; and an inflatable throat section connecting the main body and extension, said throat section defining in a longitudinal plane a curve having a radius substantially equal to the width of the extension so that, when the main body and extension are inflated, they form a unitary semi-rigid structure and the extension serves as a distinct handle.

2. A balloon according to claim 1 wherein the main body and the extension are made of a flexible, substantially unstretchable material.

3. A balloon according to claim 1 wherein the main body and the extension are in fluid communication so that either can be inflated by inflation of the other.

4. A balloon according to claim 1 wherein the main body and the extension are in fluid communication further comprising stucture defining an opening in the extension for inflating the main body and the extension.

5. A balloon according to claim 4 further comprising a valve for selectively permitting or blocking passage of fluid through the opening, whereby the main body and the extension can be selectively inflated or deflated.

6. A balloon according to claim 5 wherein the valve is self-sealing.

7. A balloon according to claim 1 further comprising a film attached to the balloon to enhance extension rigidity and resistance to tearing into hazardous small parts.

8. A balloon according to claim 1 wherein the handle accommodates the hand of a child.

* * * * *